US006637153B2

(12) United States Patent
Gies

(10) Patent No.: US 6,637,153 B2
(45) Date of Patent: Oct. 28, 2003

(54) IN-GROUND SAND RECEPTACLE WITH DISTANCE INDICATING INDICIA FOR USE ON A GOLF COURSE

(76) Inventor: David C. Gies, 11720 Cricketfield Ct., Charlotte, NC (US) 28277

( * ) Notice: Subject to any disclaimer, the term of this patent is extended or adjusted under 35 U.S.C. 154(b) by 0 days.

(21) Appl. No.: 09/994,323

(22) Filed: Nov. 26, 2001

(65) Prior Publication Data

US 2003/0097785 A1 May 29, 2003

(51) Int. Cl.[7] ..... A01G 9/02
(52) U.S. Cl. ..... 47/65.5; 47/58.1 R; 473/176
(58) Field of Search ..... 47/41.14, 41.1, 47/65.5; 220/484; 473/175, 176, 177, 178, 179; D21/793, 794

(56) References Cited

U.S. PATENT DOCUMENTS 419,905 A * 1/1890 Zapp ..... 220/484
2,255,277 A * 9/1941 Bronson ..... 47/41.1
3,584,739 A * 6/1971 Erichson et al. ..... 206/349
D321,235 S * 10/1991 Weber ..... D21/789
5,532,677 A * 7/1996 Miller ..... 340/286.01
5,647,413 A * 7/1997 Horrell ..... 141/108
5,953,859 A * 9/1999 Cochran et al. ..... 47/66.5
6,267,269 B1 7/2001 Kates

FOREIGN PATENT DOCUMENTS

JP 1120845 A * 5/2001 ..... A63G/31/00

* cited by examiner

*Primary Examiner*—Peter M. Poon
*Assistant Examiner*—Son T. Nguyen
(74) *Attorney, Agent, or Firm*—Schwartz Law Firm, P.C.

(57) ABSTRACT

An in-ground sand receptacle contains sand used to repair divots in a golf course. The receptacle includes a plurality of walls defining an enclosure adapted for residing below a ground surface of the golf course. The enclosure has an open top for receiving sand therein. A lid removably covers the open top of the enclosure. Indicia is applied to the lid for indicating a distance between the receptacle and a predetermined point on the golf course.

18 Claims, 1 Drawing Sheet

IN-GROUND SAND RECEPTACLE WITH DISTANCE INDICATING INDICIA FOR USE ON A GOLF COURSE

TECHNICAL FIELD AND BACKGROUND OF INVENTION

This application relates to an in-ground sand receptacle for use on a golf course, and including indicia indicating the distance from the receptacle to a predetermined point on the golf course. The invention is located below grade in an area of the fairway or teeing ground, and at a strategic location where divots are most likely to occur.

A primary object of the invention is to encourage the repair and restoration of divots. When left unattended, fairway divots can hamper the play of golfers who follow. Those having the misfortune of landing their ball in an existing divot are especially disadvantaged, as clean and accurate shots from an existing divot are generally difficult to make. To address this problem, many golf courses equip their golf carts with hand-held sand bottles. After a shot is taken in the fairway, the golfer is instructed to take the sand bottle from the cart and fill-in the divot. Because the cart is often located on a prescribed golf path several yards from the shot, many golfers simply ignore the divot and move on. The inconvenience of walking the extra distance to repair the divot generally outweighs the golfer's sense of obligation to maintain the fairway for those players who follow.

The present invention encourages the repair of divots by providing sand in an in-ground receptacle conveniently located in the fairway or teeing ground, while drawing the golfer's attention to the sand receptacle using distance-indicating indicia. As the golfer locates his ball in the fairway, he first walks to the in-ground receptacle to determine the distance to the pin. He then removes a small amount of sand from the receptacle, and walks to his ball to take his shot. After the shot, the sand is used to repair the divot.

SUMMARY OF INVENTION

Therefore, it is an object of the invention to provide an in-ground sand receptacle for use on a golf course which promotes and encourages the repair and restoration of divots.

It is another object of the invention to provide an in-ground sand receptacle which is conveniently located in an area of the fairway or teeing ground.

It is another object of the invention to provide an in-ground sand receptacle which does not interfere with the travel path of the golf ball.

It is another object of the invention to provide an in-ground sand receptacle which does not interfere with course maintenance equipment, such as mowers and seeders.

It is another object of the invention to provide an in-ground sand receptacle which includes indicia indicating the distance from the receptacle to a predetermined point on the golf course.

These and other objects of the present invention are achieved in the preferred embodiments disclosed below by providing an in-ground sand receptacle for containing sand used to repair divots in a golf course. The receptacle includes a plurality of walls defining an enclosure adapted for residing below a ground surface of the golf course. The enclosure has an open top for receiving sand therein. A lid removably covers the open top of the enclosure. Indicia is applied to the lid for indicating a distance between the receptacle and a predetermined point on the golf course.

The term "sand" as used herein refers to any loose granular material suitable for use on a golf course to repair divots.

The term "indicia" refers broadly to any distinctive marking.

According to another preferred embodiment of the invention, the indicia includes a numeric marking.

According to another preferred embodiment of the invention, the indicia includes a color marking.

According to another preferred embodiment of the invention, a scoop is located within the enclosure for dispensing sand contained therein.

According to another preferred embodiment of the invention, the lid is pivotally attached to one of the receptacle walls.

According to another preferred embodiment of the invention, the receptacle walls are integrally formed together of a molded plastic material.

According to another preferred embodiment of the invention, a top surface of the lid is substantially flat.

According to another preferred embodiment of the invention, the lid is adapted to substantially seal the open top of the enclosure to limit entry of water and debris inside the enclosure.

In another embodiment, the invention is an in-ground sand receptacle used to repair divots in a golf course. The receptacle includes a plurality of walls defining an enclosure adapted for residing below a ground surface of the golf course. The enclosure has an open top for receiving sand therein. A lid removably covers the open top of the enclosure and has a substantially flat top surface. Indicia is applied to the top surface of the lid for indicating a distance between the receptacle and a predetermined point on the golf course.

In yet another embodiment, the invention is a method for promoting the repair of divots in a golf course. The method includes the steps of locating a sand receptacle below a ground surface of the golf course for containing sand used to repair divots. Indicia is provided on the sand receptacle indicating a distance between the receptacle and a predetermined point on the golf course.

According to another preferred embodiment of the invention, the step of providing indicia includes providing a numeric marking on the sand receptacle.

According to another preferred embodiment of the invention, the step of providing indicia includes providing a color marking on the sand receptacle.

According to another preferred embodiment of the invention, a scoop is provided in the sand receptacle for transferring sand from the receptacle to the golf course.

According to another preferred embodiment of the invention, an open top of the sand receptacle is removably covered to limit the entry of water and debris into the sand receptacle.

According to another preferred embodiment of the invention, a top of the sand receptacle is located at an elevation corresponding substantially to the ground surface of the golf course.

According to another preferred embodiment of the invention, the step of locating the sand receptacle includes forming a hole in a fairway of the golf course for receiving and housing the sand receptacle.

According to another preferred embodiment of the invention, the step of locating the sand receptacle includes forming a hole in a teeing ground of the golf course for receiving and housing the sand receptacle.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
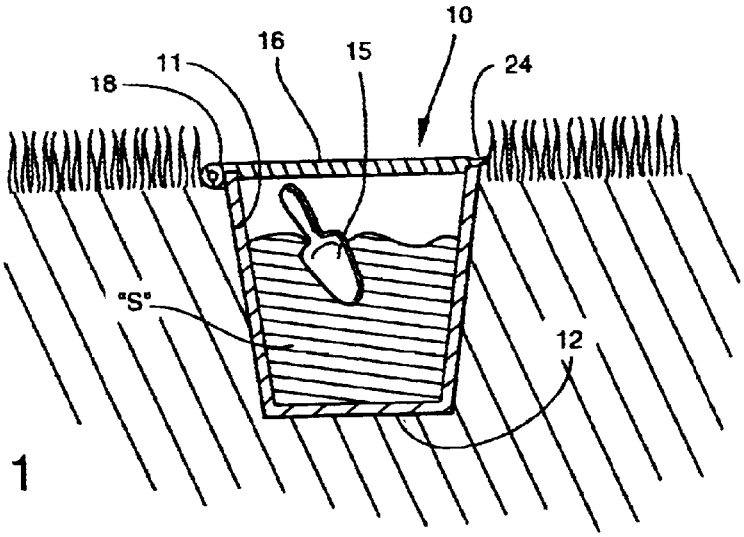
FIG. 1 is an environmental cross-section of the in-ground sand receptacle with the lid of the receptacle closed.
Figure 2:
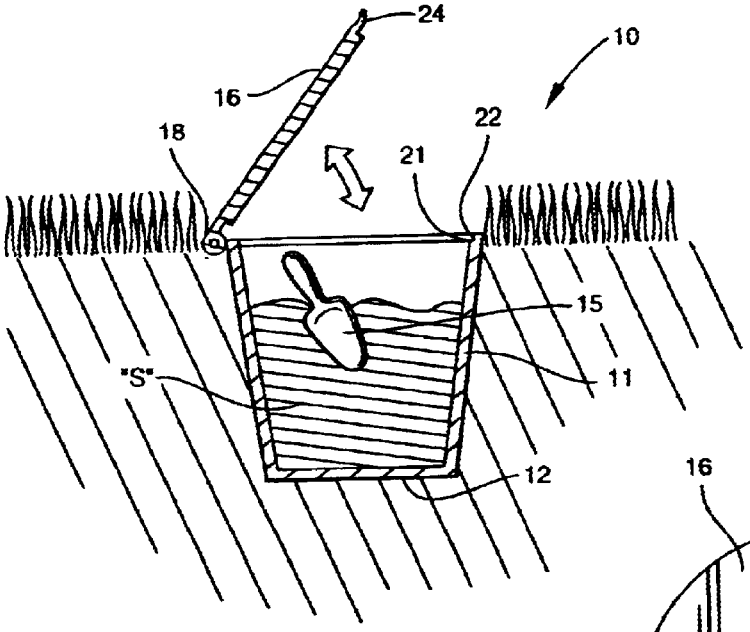
FIG. 2 is an environmental cross-section of the in-ground sand receptacle with the lid of the receptacle open.

Referring now specifically to the drawings, an in-ground sand receptacle according to the present invention is illustrated in FIGS. 1 and 2, and shown generally at reference numeral 10. The sand receptacle 10 is especially adapted for placement below grade in a fairway or teeing ground of a golf course. The receptacle 10 includes a generally conical side wall 11 and a bottom wall 12 cooperating to form an enclosure for containing sand "S". The sand "S" is used by golfers to repair and restore divots in the fairway and teeing ground. A convenient scoop 15 is located inside the enclosure for removing and carry the sand "S" to the divot.

Figure 3:
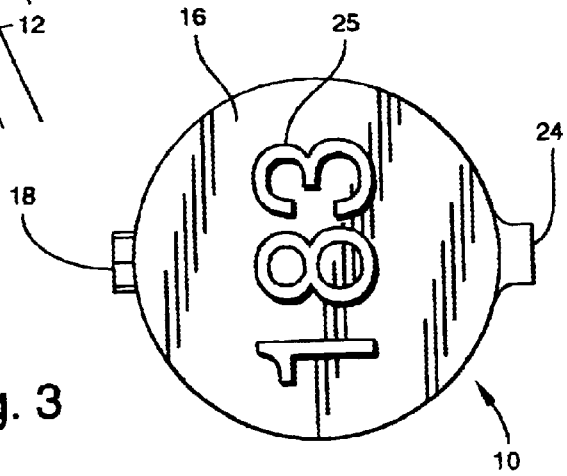
FIG. 3 is a top plan view of the sand receptacle showing the indicia applied to the lid.

As best indicated in FIG. 2, the sand receptacle 10 has a pivoted lid 16 attached by a hinge 18 and movable between open and closed positions. In the closed position, shown in FIG. 1, the lid 16 seats on an annular shoulder 21 formed adjacent a top inside edge 22 of the receptacle 10. The lid 16 frictionally engages the top inside edge 22 to substantially seal the enclosure against entry of water and debris. A lift tab 24 is formed with the lid 16 opposite the hinge 18 to allow convenient opening and closing. The top surface of the lid 16 is generally flat, and includes indicia 25 indicating the distance of the receptacle 10 to a point on the golf course-e.g., the pin on the green. As shown in FIG. 3, the indicia 25 is preferably a yardage number. Alternatively, the indicia may be a particular color, symbol, or other distinctive marking.

When positioned in-ground, as shown in FIGS. 1 and 2, the closed lid 16 of the sand receptacle 10 is substantially flush with the ground surface to avoid interfering with the travel path the golf ball. Additionally, because the sand receptacle 10 is located below grade, it does not interfere with course maintenance equipment, such as mowers and seeders. Thus, the receptacle 10 may be strategically located in any area of the fairway or teeing ground where divots are likely to occur.

An in-ground sand receptacle for a golf course is described above. Various details of the invention may be changed without departing from its scope. Furthermore, the foregoing description of the preferred embodiment of the invention and best mode for practicing the invention are provided for the purpose of illustration only and not for the purpose of limitation-the invention being defined by the claims.

What is claimed is:

1. An in-ground sand receptacle for containing sand used to repair divots in a golf course, said receptacle comprising:

(a) a plurality of earth engaging walls defining an enclosure adapted for residing below a ground surface of the golf course, said enclosure having an open top for receiving sand therein;

(b) a lid removably covering the open top of said enclosure; and (c) indicia applied to said lid for indicating a distance between said receptacle and a predetermined point on the golf course, whereby the indicia draws a golfer's attention to said receptacle and serves to promote the use of sand to repair divots in the golf course.

2. An in-ground sand receptacle according to claim 1, wherein said indicia comprises a numeric marking.

3. An in-ground sand receptacle according to claim 1, wherein said indicia comprises a color marking.

4. An in-ground sand receptacle according to claim 1, and comprising a scoop located within said enclosure for dispensing sand contained therein.

5. An in-ground sand receptacle according to claim 1, wherein said lid is pivotally attached to one of said receptacle walls.

6. An in-ground sand receptacle according to claim 1, wherein said receptacle walls are integrally formed together of a molded plastic material.

7. An in-ground sand receptacle according to claim 1, wherein a top surface of said lid is substantially flat.

8. An in-ground sand receptacle according to claim 1, wherein said lid is adapted to substantially seal the open top of said enclosure to limit entry of water and debris inside said enclosure.

9. A method for promoting the repair and restoration of divots in a golf course, comprising the steps of:

(a) locating a sand receptacle below a ground surface of the golf course, said sand receptacle containing sand used to repair divots; and (b) drawing a golfer's attention to the sand receptacle using indicia on the sand receptacle indicating a distance between the receptacle and a predetermined point on the golf course.

10. A method according to claim 9, wherein the step of providing indicia comprises providing a numeric marking on the sand receptacle.

11. A method according to claim 9, wherein the step of providing indicia comprises providing a color marking on the sand receptacle.

12. A method according to claim 9, and comprising providing a scoop in the sand receptacle for transferring sand from the receptacle to the golf course.

13. A method according to claim 9, and comprising removably covering an open top of the sand receptacle to limit the entry of water and debris into the sand receptacle.

14. A method according to claim 9, and comprising locating a top of the sand receptacle at an elevation corresponding substantially to the ground surface of the golf course.

15. A method according to claim 9, wherein the step of locating the sand receptacle comprises forming a hole in a fairway of the golf course for receiving and housing the sand receptacle.

16. A method according to claim 9, wherein the step of locating the sand receptacle comprises forming a hole in a teeing ground of the golf course for receiving and housing the sand receptacle.

17. An in-ground sand receptacle for containing sand used to repair divots in a golf course, said receptacle comprising:

(a) a plurality of walls defining an enclosure adapted or residing below a ground surface of the golf course, said enclosure having an open top and containing sand therein;

(b) a lid removably covering the open top of said enclosure; and (c) indicia applied to said lid for indicating a distance between said receptacle and a predetermined point on the golf course.

18. A method for repairing divots in a golf course, comprising the steps of:

(a) locating a sand receptacle below a ground surface of the golf course for containing sand used to repair divots;

(b) drawing a golfer's attention to the sand receptacle using indicia on the sand receptacle indicating a distance between the receptacle and a predetermined point on the golf course;

(c) removing an amount of sand from the receptacle using a scoop;

(d) carrying the scoop and sand to a ball located on the golf course;

(e) after striking the all and creating a divot, using the sand to repair the divot; and (f) returning the scoop to the sand receptacle.

* * * * *